US005110646A

United States Patent [19]

Prestel et al.

[11] Patent Number: 5,110,646

[45] Date of Patent: May 5, 1992

[54] PROCESS AND MATERIALS FOR RECONDITIONING A TONER CARTRIDGE

[75] Inventors: James D. Prestel, 26478 Calle San Francisco, San Juan Capistrano, Calif. 92675; Mitchel S. Hose, Garden Grove; Paul J. Barbour, Santa Anna, both of Calif.

[73] Assignee: James D. Prestel, San Juan Capistrano, Calif.

[21] Appl. No.: 645,809

[22] Filed: Jan. 25, 1991

[51] Int. Cl.[5] ..... B65D 65/28; G03G 15/06

[52] U.S. Cl. ..... 428/43; 29/401.1; 229/123.2; 355/245; 355/260; 428/138

[58] Field of Search ..... 355/260, 202, 200, 298, 355/245, 77; 206/601, 605, 608, 611, 631, 620; 222/DIG. 1; 229/123.2; 29/401.1; 428/43, 138

[56] References Cited

U.S. PATENT DOCUMENTS 4,732,277 3/1988 Smith ..... 355/260 X
4,816,877 3/1989 Keen ..... 355/260 X
4,862,210 8/1989 Woolley ..... 355/260 X

OTHER PUBLICATIONS

Repeat-O-Type, "User Refillable," Laser Printer Supplies, Nov. 1989.
Consumer Watch, "Caveat Empties," Nov. 1988.

*Primary Examiner*—A. T. Grimley
*Assistant Examiner*—Sandra L. Brasé
*Attorney, Agent, or Firm*—Edgar W. Averill, Jr.

[57] ABSTRACT

A process and apparatus for reconditioning a toner cartridge of the type used in laser printers after the toner has been exhausted. The process includes removing the magnetic roller to expose an elongated toner opening and covering the elongated toner opening with a perforated separator sheet. Next, the magnetic roller is replaced, and the cartridge is refilled with toner only to be regenerated by tearing off the center portion of the separator sheet. The separator sheet has a perforation pull-off center portion and an adhesive backing.

5 Claims, 3 Drawing Sheets

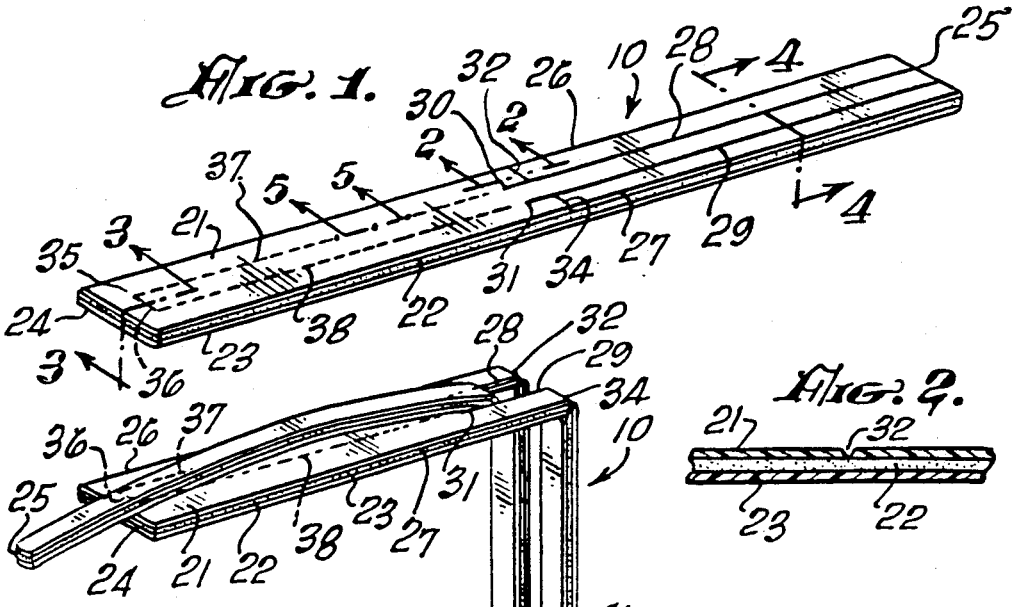
FIG. 1.
25
28
10
26
32
4
30
2
2
37
5
5
21
3
35
24
3
36
23
38
22
31
34
27
29
4
28
32
29
34
10
36
26
37
25
24
21
22
38
23
27
31
FIG. 2.
21
32
23
22
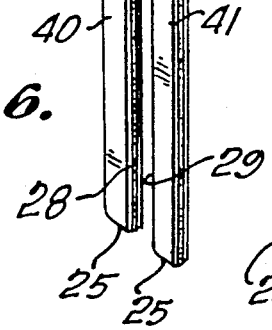
40
41
FIG. 6.
28
29
25
25
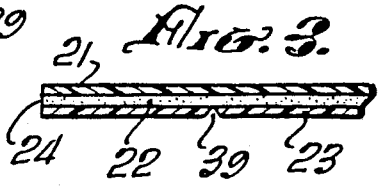
FIG. 3.
21
24
22
39
23
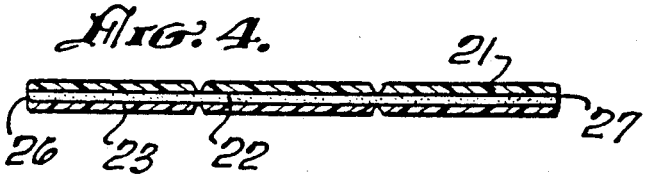
FIG. 4.
21
26
23
22
27
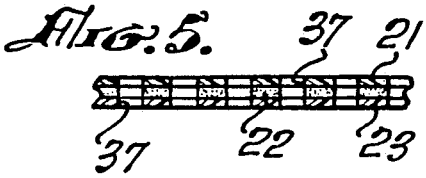
FIG. 5.
37
21
37
22
23

PROCESS AND MATERIALS FOR RECONDITIONING A TONER CARTRIDGE

BACKGROUND OF THE INVENTION

The field of the invention is xerography, and the invention relates more particularly to toner cartridges of the type commonly used with laser printers.

Typically, when the toner cartridge of a laser printer has been used for 2,000 to 2,500 copies, the toner is exhausted. Most laser printer manufacturers direct the user to discard the old toner cartridge, which also includes a magnetic roller, a cleaning strip, gears and other parts, and purchase a new cartridge which is filled with toner.

This step is expensive and wasteful in that many useful parts are discarded merely because the toner is expended. One cannot, however, simply replace the toner since substantial amounts would leak out during shipping.

SUMMARY OF THE INVENTION

It is an object of the present invention to provide a process which permits the refilling of toner cartridges of the type used with laser printers which provides a leak-free compartment for the toner until it is ready for use.

It is another object of the present invention to provide a toner cartridge slot cover strip with a tear away center section.

The present invention is for a process for reconditioning a toner cartridge from which the toner has been exhausted. The toner cartridge is of the type having a cartridge body with a toner filler cap. The cartridge body also has an elongated opening and a magnetic roller, and a cleaning strip is positioned above the elongated opening in use. The process includes the steps of removing the magnetic roller and cleaning strip and placing a perforated separator sheet, having an adhesive backing, over the elongated opening. The perforated separator sheet also has a perforated, longitudinal center section, and a portion of the center section is attached to a pull strip which extends outwardly from the cartridge. The cleaning strip and magnetic roller are then replaced, and the toner filler cap is removed, toner added and the cap replaced. The resulting reconditioned toner cartridge can be activated merely by pulling the pull strip. The slot cover strip of the present invention includes a tear away center section and comprises an elongated, three-layer laminated sheet having an upper thin, polymeric layer, a delayed tack middle layer and a release paper bottom layer. The elongated three-layer laminated sheet has a first end, a second end and right and left longitudinal edges. The sheet has first and second cuts parallel to the right and left longitudinal edges dividing the sheet into three approximately equal portions. The beginning portion of the first and second cuts begins at the second end and extends through all three layers of the laminated sheet and is parallel to the edges and extends toward the first end a distance greater than half the length between the first end and the second end. The full cuts terminate near the middle of the sheet at a full cut termination. The perforated portions of the first and second cuts begin at the full cut terminations and continue parallel to the edges to a point near the first end called the perforation terminations. The perforated portions are spaced cuts through all three layers, and the perforated portions are joined at the perforation terminations with a perforated cut. A first and second transverse cut extends through only the upper thin, polymeric layer extending from each of the full cut terminations to the nearest longitudinal edge. A transverse cut, only through the backing layer, extends between the perforation terminations.

BRIEF DESCRIPTION OF THE DRAWINGS

FIG. 1 is a perspective view of the toner cartridge slot cover strip of the present invention.

FIG. 2 is an enlarged cross-sectional view taken along line 2—2 of FIG. 2.

FIG. 3 is an enlarged cross-sectional view taken along line 3—3 of FIG. 1.

FIG. 4 is an enlarged cross-sectional view taken along line 4—4 of FIG. 1.

FIG. 5 is an enlarged cross-sectional view taken along line 5—5 of FIG. 1.

FIG. 6 is a perspective view of the elongated, three-part laminated sheet of FIG. 1 with the center section turned back upon itself.

DESCRIPTION OF THE PREFERRED EMBODIMENTS

Figure 8:
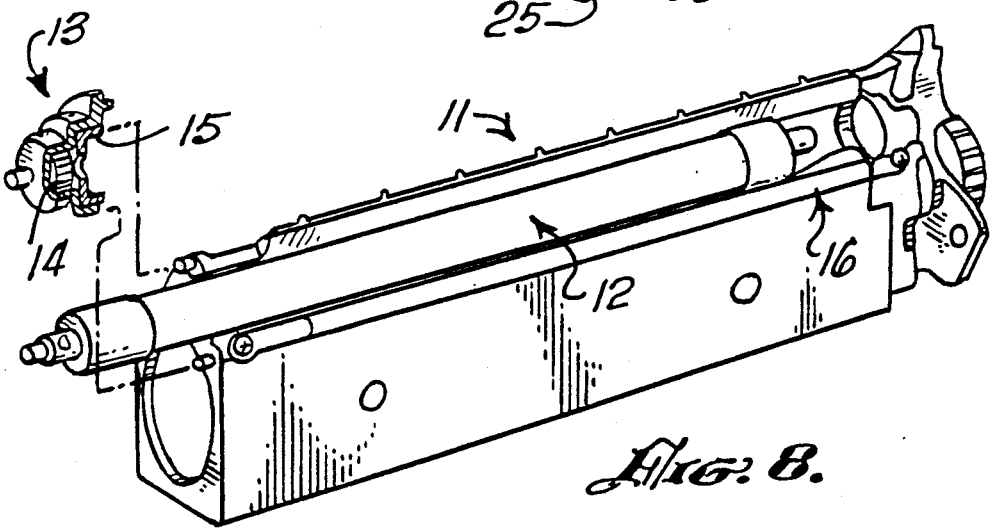
FIG. 8 is a perspective view of the toner cartridge which may be regenerated with the process of the present invention.
Figure 9:
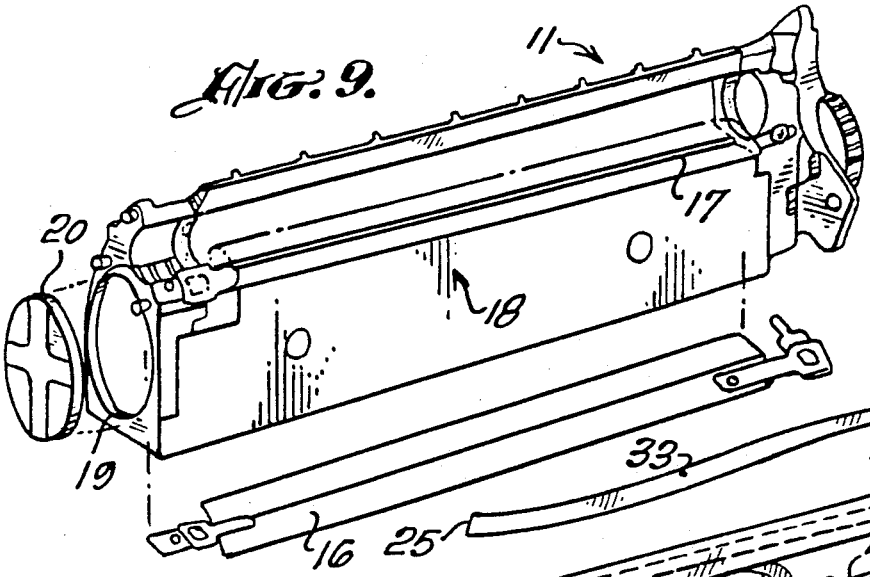
FIG. 9 is a perspective view of the toner cartridge of FIG. 8 with the cleaning strip removed therefrom.
Figure 10:
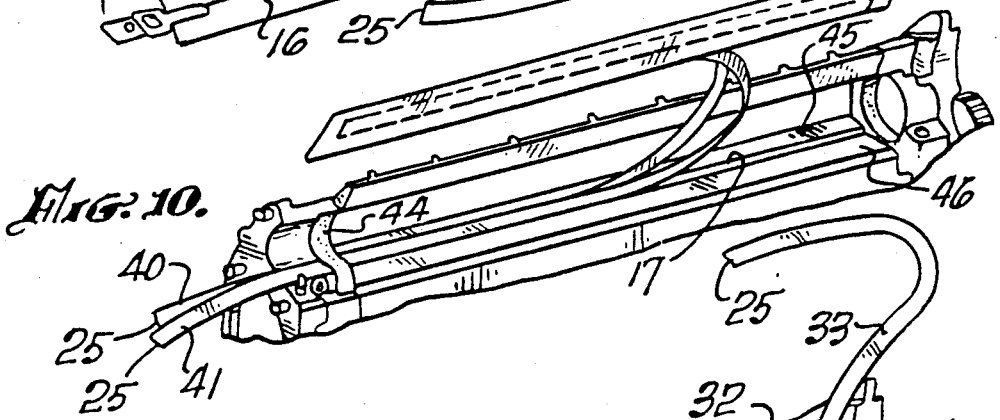
FIG. 10 is a perspective view of the toner cartridge of FIG. 8 with the elongated, three-part laminated sheet of FIG. 1 thereabove.

A toner cartridge slot cover sheet 10 is shown in perspective view in FIG. 1 and is used to temporarily cover the slot in a toner cartridge to prevent the toner from leaking out after the cartridge has been reconditioned. A toner cartridge of the type useful with the cover sheet 10 of FIG. 1 is shown in perspective view in FIGS. 8 and 9 and indicated generally by reference character 11. The toner cartridge in FIG. 8 has a magnetic roller housing 12 which is held to the cartridge by a housing end piece 13 which includes a gear 14 and a bearing 15 for the roller. With end piece 13 removed, the magnetic roller housing 12 can be slid out in the direction shown in FIG. 8 exposing a cleaning strip 16. When the cleaning strip is removed, as shown in FIG. 9, a toner slot 17 is fully exposed. Toner slot 17 is at the upper end of a toner reservoir 18 which has an opening 19 at one end which is closed with an end cap 20 which may be removed and replaced.

During the use of a laser printer or other xerographic type device, the toner cartridge 11 transfers toner from toner reservoir 18 via magnetic roller housing 12 to the imaging drum. The toner is, thus, slowly used up during the operation of the laser printer and, typically, after 2,000 to 2,500 sheets, the toner cartridge must be replaced. The recommended procedure is to throw away the entire toner cartridge magnetic roller housing, end cap and gears, shown in FIG. 8, and to replace the same with a new cartridge which is filled with toner. The object of the present invention is to avoid this wasteful step and, instead, to replace the toner into the toner reservoir by removing end cap 20 and filling the reservoir with new toner. The problem with this approach is that when it is done at a remote location, the shaking which occurs during shipment causes the toner to leak out of slot 17. Since the toner is black and would be readily transferred to the user's hands, this is unacceptable. It is, thus, desired to cover up, temporarily, slot 17 so that the toner will be retained inside the reservoir 18, and the cartridge will arrive at its destination in a clean condition. The difficulty with this, however, is it is necessary for the user to remove the cover and it is not practical for the user to remove the magnetic roller as shown in FIG. 8.

This problem has been solved, however, by the provision of toner cartridge slot cover sheet 10 shown in FIG. 1 of the drawings.

Toner cartridge slot cover sheet 10 is an elongated, laminated sheet which is shown in cross-sectional view in FIGS. 2, 3, 4 and 5. As is shown in all of these figures, the lamination has an upper thin, polymeric layer 21. It has been found that a highly opaque, filled and oriented polypropylene film having a thickness between 4.2 and 4.5 mils with adhesive is very satisfactory. The adhesive is a delayed tack adhesive and forms the middle layer 22 of the laminated sheet. A release paper backing 23 forms the bottom layer of the laminated sheet, and this is peeled off a portion of the laminated sheet so that a portion of the delayed tack adhesive is exposed.

Sheet 10 has numerous cuts and perforations therein. In order to describe the position of these cuts, sheet 10 is labeled as follows. First end 24 is at the left side of the sheet, as viewed in FIG. 1, and second end 25 is at the right side. Then, as viewing the sheet from first end 24, the left longitudinal edge 26 and the right longitudinal edge 27 form the two elongated sides. A first cut 28 extends from second end 25 to full cut termination 30. Second cut 29 also extends from second end 25 to a full cut termination point 31. The full cut is shown in cross-sectional view along line 4—4 in FIG. 4. Since the adhesive is a delayed tack adhesive, it tends to hold the cuts together, but they are easily separated by pulling the same apart. A first transverse cut 32 extends completely through the thin, polymeric layer 21, but does not extend into the center strip 33, nor does it extend into the paper backing layer 23. Likewise, a second transverse cut 34 extends from the right longitudinal edge 27 to the second cut 29 and extends through only the upper thin, polymeric layer. A perforated cut extending through all three layers passes from full cut termination 30 to a perforation termination 35. It has been found that perforations of 50 to 72 spaced cuts per inch give a good balance of strength and still retain the ability to pull or tear away. A transverse perforation cut 36 also extends through all three layers. A second perforation cut 38 also extends from transverse perforation cut 36 to full cut termination 31. This perforation cut is also through all three layers and is the same as that shown in cross-sectional view along line 5—5. Lastly, a full cut is formed between perforation terminations 35 and 36 in the release paper backing 23, as shown in FIG. 3, and this full cut is indicated by reference character 39.

Figure 7:
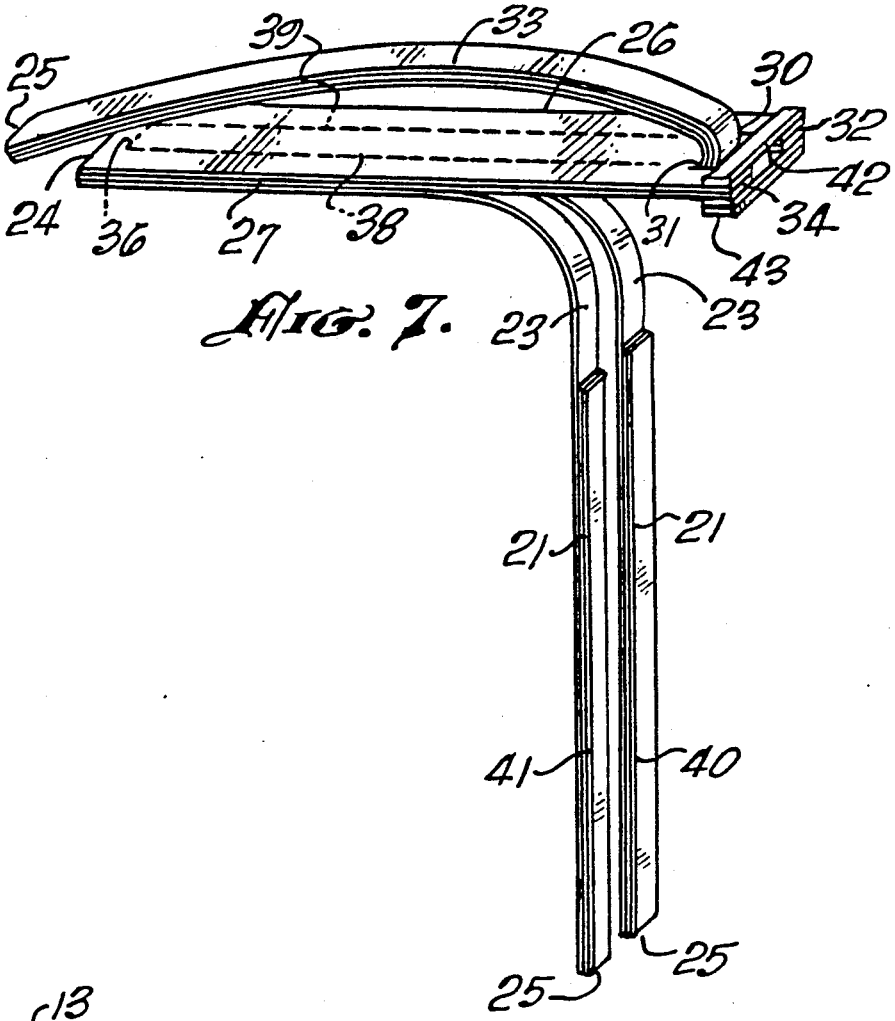
FIG. 7 is a perspective view of the elongated, three-part laminated sheet of FIG. 1 showing the first and third portions thereof partially pulled away from the adhesive backing of the laminate.

The first step is shown in FIG. 6 where center strip 3 is folded back and separated at first and second cuts 2 and 29. Next, as shown in FIG. 7, the right strip 41 and the left strip 40 are pulled downwardly and separated at transverse cuts 32 and 34 so that the upper thin, polymeric layer 21 is removed between transverse cut 34 and end 25 and transverse cut 32 and end 25. Thus, only the backing paper 23 is removed between transverse cut 34 and first end 24 and between transverse cut 32 and first end 24. This, of course, exposes the adhesive between transverse cuts 32 and 34 and the point at which the backing paper 23 is pulled off the bottom. The center strip 33 extends past the first end 24 and provides as a pull tab as shown more fully below.

Preferably, two sheets of adhesive exposed polymer 42 and 43 are adhered to the end adjacent cuts 32 and 34 to assist in peeling back the center strip 33 as described more fully below. Thus, sheet 43 with its adhesive side down is placed inwardly from cuts 32 and 34, and sheet 42 with its adhesive side down is adhered over that. This causes the center strip 33 to more easily separate along perforations 38 and 39.

Figure 11:
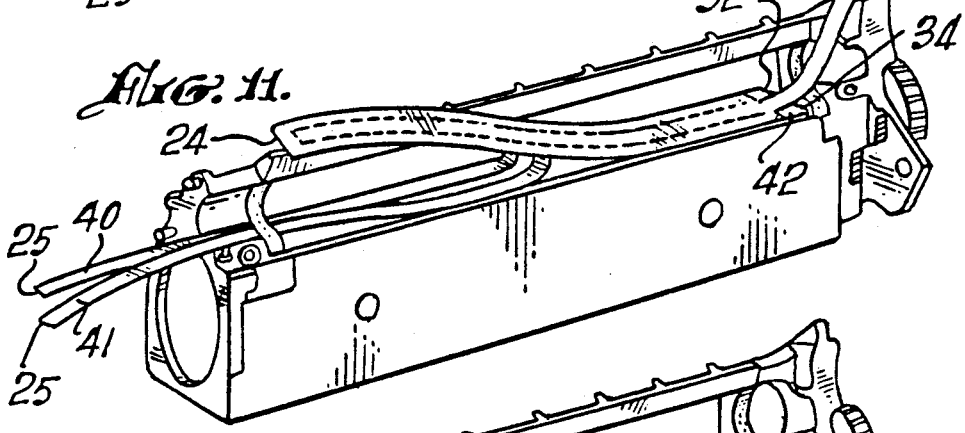
FIG. 11 is a perspective view of the toner cartridge of FIG. 10 with the elongated sheet of FIG. 1 partially adhered thereto.
Figure 12:
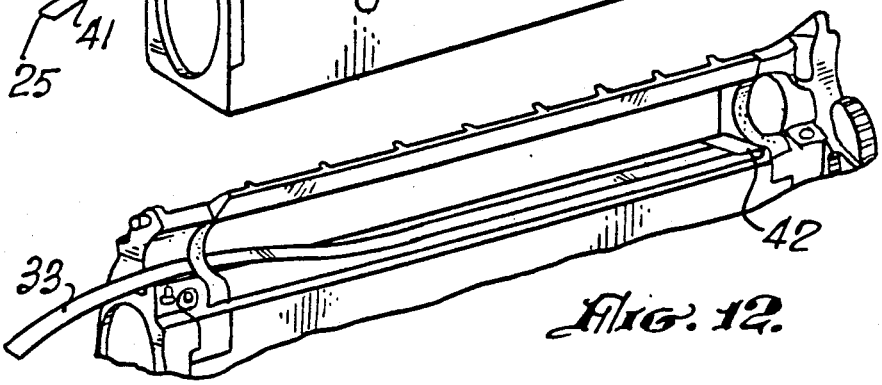
FIG. 12 is a perspective view of the toner cartridge and sheet of FIG. 11 with the sheet fully affixed thereto.

In order to recondition toner cartridge 11 as stated above, and as shown in FIGS. 8 and 9, the magnetic roller housing 12 is removed after removing housing end piece 13 which includes gear 14 and bearing 15. Next, cleaning strip 16 is removed, as shown in FIG. 9, which exposes the toner slot 17. Next, the two strips 40 and 41 are fed under felt strip 44. Next, the adhesive exposed ends adjacent transverse cuts 32 and 34 are adhered to the upper surfaces 45 and 46 adjacent and surrounding slot 17 of cartridge 11. Then, as shown in FIG. 11, strips 40 and 41 are pulled further, and the strip is pressed down on upper surfaces 45 and 46 until strips 40 and 41 are completely removed. Strips 40 and 41 are joined together at end 24 adjacent full cut 39 (see FIG. 3). After these strips have been removed, the sheet is completely adhered over slot 17 with the paper backed adhesive completely covering the slot. Then, the magnetic roller housing 12 is slid back into place, and the housing end piece, with its gear 14 and roller bearing 15, are also replaced. Lastly, the end cap 20 is removed from opening 19, and the reservoir is filled with fresh toner and the end cap is replaced. The center strip 33 continues to extend past the end cap 20 after the roller has been replaced. Preferably, a pull tab 33' is affixed to the end of center strip 33 as shown in FIG. 12. When the end user receives the reconditioned cartridge from the reconditioner, the user merely needs to pull center strip 33 from under magnetic roller housing 12 thereby exposing the toner and energizing the cartridge for another 2,000 to 2,500 uses.

The cartridge assembly as provided by the manufacturer also includes an imaging drum which can be reused from five to ten times without loss of image quality. Whereas original cartridges typically cost between $75.00 and $110.00, a refilled cartridge is about half this much. Therefore, the savings by use of the toner cartridge slot cover sheet of the present invention can be substantial.

The present embodiments of this invention are thus to be considered in all respects as illustrative and not restrictive; the scope of the invention being indicated by the appended. claims rather than by the foregoing description. All changes which come within the meaning and range of equivalency of the claims are intended to be embraced therein.

What is claimed is:

1. A process for reconditioning a toner cartridge from which the toner has been exhausted, said toner cartridge being of the type having a cartridge body with a toner filler cap and said cartridge body having a top surface having an elongated opening therein and having a magnetic roller and a cleaning strip positioned above the elongated opening, said process comprising:

removing the magnetic roller and cleaning strip;

placing a perforated separator sheet having an adhesive backing and a perforated longitudinal center section over the elongated opening, said perforated longitudinal center section having an extending pull-back strip;

replacing the cleaning strip and magnetic roller;

removing the toner filler cap;

filling the cartridge with toner; and replacing the toner filler cap.

2. A toner cartridge slot cover strip with a tear-away center section for facilitating the regeneration of used toner cartridges of the type having a cartridge body with a toner slot adjacent a magnetic roller and cleaner strip, said toner cartridge slot cover strip comprising:

a elongated, three layer laminated sheet having an upper thin polymeric layer, a delayed tack middle layer and a release paper bottom layer, said elongated, three layer laminated sheet having a first end, a second end, a left-longitudinal edge and a right-longitudinal edge, said sheet having first and second cuts parallel to the left and right longitudinal edges dividing the sheet into three approximately equal portions;

the beginning portions of said first and second cuts beginning at the second end and extending through all three layers of said elongated, three layer laminated sheet and extending parallel to the right and left edges toward the first end a distance greater than half the length between the first end and the second end, said beginning portions of the first and second cuts being the full cut portions which terminate near the middle of the sheet at a full cut termination;

the perforated portions of the first and second cuts begin at the full cut termination and continue parallel to the right and left longitudinal edges to a point near the first end called the perforation terminations, said perforated portions being spaced cuts with uncut portions therebetween to provide a tear off ability and said perforated portions being joined at the perforation terminations near the first end and said spaced cuts extending through all three layers of said sheet;

a first and second transverse cut through only the upper thin polymeric layer extending from each of the full cut near the full cut terminations to the nearest longitudinal edge; and a transverse cut only through the backing layer between the perforation terminations.

3. The toner cartridge slot cover strip of claim 2 wherein said upper, thin, polymeric layer is fabricated from polypropylene.

4. The toner cartridge slot cover strip of claim 2 wherein said perforation has about 50 to 72 spaced cuts per inch.

5. The toner cartridge slot cover strip of claim 2 wherein the first and second transverse cuts are spaced from the full cut terminations toward the second end.

* * * * *